US005984064A

United States Patent [19]

Byington

[11] Patent Number: 5,984,064

[45] Date of Patent: Nov. 16, 1999

[54] EXTENSION ARM FOR MOBILE TRAVELERS SUIT CASE

[75] Inventor: Gerald A. Byington, Knoxville, Tenn.

[73] Assignee: Lockheed Martin Energy Research Corporation, Oak Ridge, Tenn.

[21] Appl. No.: 08/921,282

[22] Filed: Aug. 29, 1997

[51] Int. Cl.[6] ..... A45C 13/00

[52] U.S. Cl. ..... 190/115; 16/115

[58] Field of Search ..... 190/39, 115, 18 A, 190/122; 16/115

[56] References Cited

U.S. PATENT DOCUMENTS

| | | | |
|---|---|---|---|
| 3,513,952 | 5/1970 | Warner, Jr. | 190/18 A |
| 3,960,252 | 6/1976 | Cassimally . | |
| 4,036,336 | 7/1977 | Burtley . | |
| 4,114,916 | 9/1978 | Oyama . | |
| 4,261,447 | 4/1981 | Arias et al. . | |
| 4,508,202 | 4/1985 | Siegert et al. | 16/115 X |
| 4,759,431 | 7/1988 | King et al. | 190/18 A |
| 5,322,334 | 6/1994 | Hammer | 16/115 X |
| 5,459,908 | 10/1995 | Chen | 16/115 |
| 5,500,981 | 3/1996 | Ho | 16/115 |
| 5,560,458 | 10/1996 | Franklin et al. | 190/115 |
| 5,620,070 | 4/1997 | Wang | 190/115 |
| 5,628,088 | 5/1997 | Chen | 190/18 A X |
| 5,694,663 | 12/1997 | Tserng . | |
| 5,729,866 | 3/1998 | Chg | 16/115 |

*Primary Examiner*—Gary E. Elkins
*Assistant Examiner*—Tri M. Mai
*Attorney, Agent, or Firm*—Hardaway/Mann IP Group; Nexsen Pruet Jacobs & Pollard LLP

[57] ABSTRACT

The invention is an apparatus for adjusting a luggage handle in relation to a luggage frame utilized to transport luggage by a traveler. The handle is connected to two extendable and retractable slide tube assemblies, the assemblies allow for the telescoping of the luggage handle to multiple positions in relation to a pair of fixed frame tubes connected to a luggage shell with wheels, to accommodate the height and personal stride of traveler. The luggage handle incorporates triggering buttons that allow ambidextrous and single-handed control of the height of the handle and slide tube assembly in relation to the luggage. The handle and slide tube assembly are connected by interior filaments to pulleys and filaments within two concentric light-weight slide tubes, which are inserted respectively into two fixed frame tubes, to allow a multitude of positions for the slide tubes to lock into the fixed frame tubes. The apparatus can be pushed or pulled by the traveler, and the support shell can accommodate multiple pieces of luggage.

11 Claims, 7 Drawing Sheets

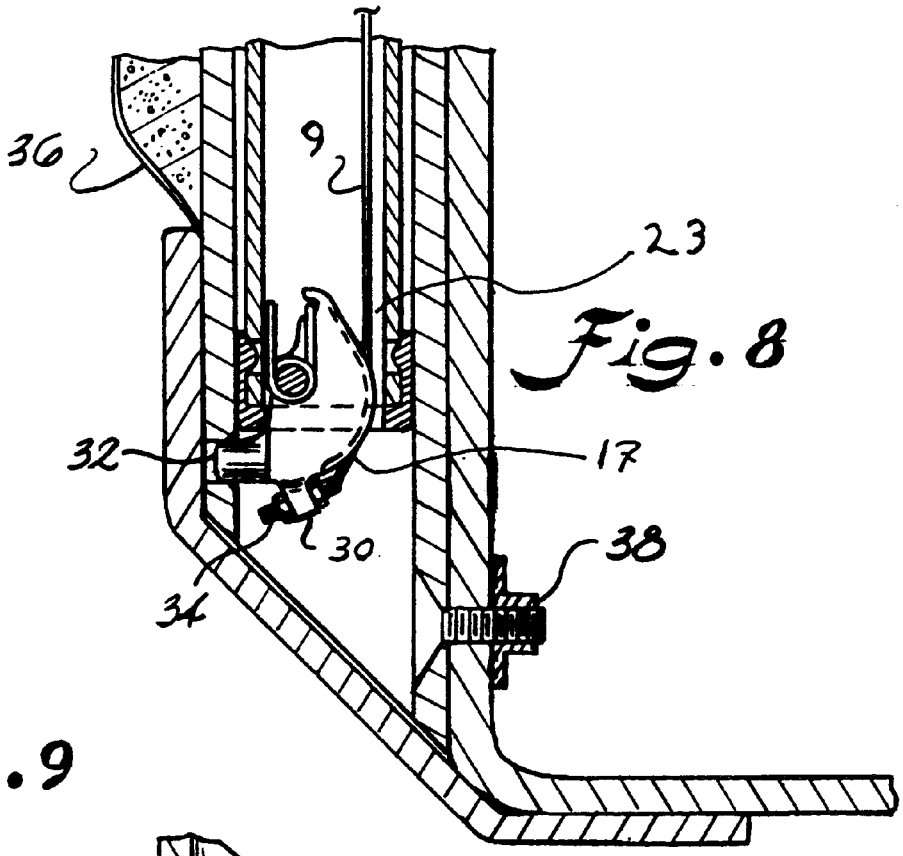
Fig. 8
Fig. 9
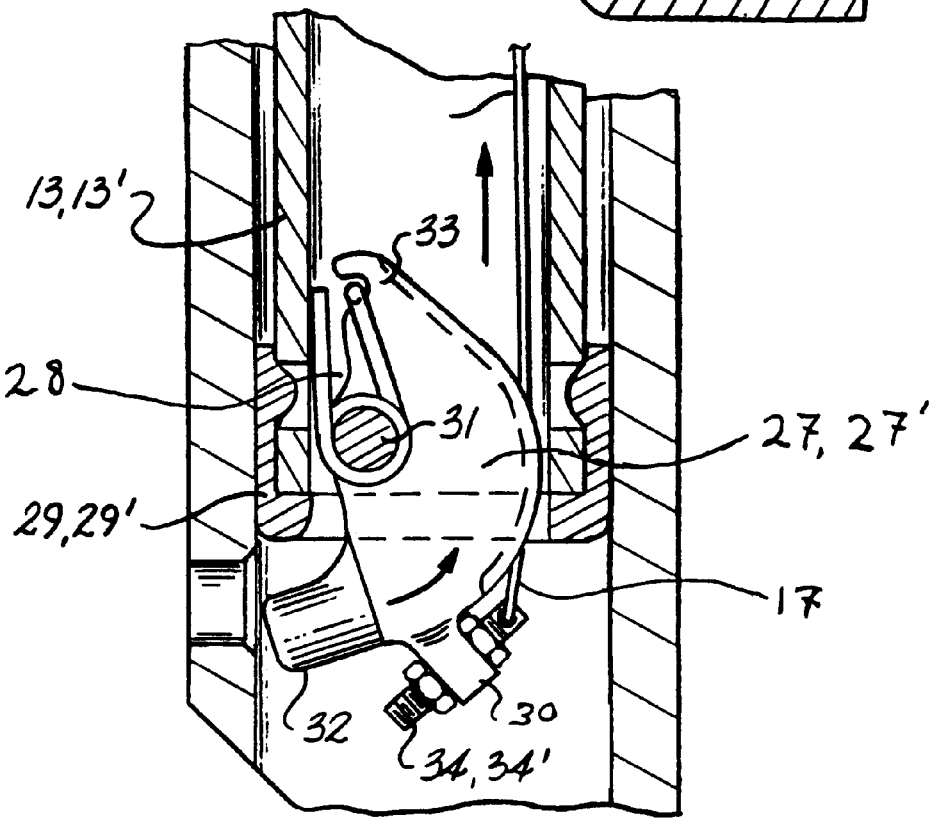

EXTENSION ARM FOR MOBILE TRAVELERS SUIT CASE

The United States Government has rights in this invention pursuant to Contract No. DE-AC05-840R21400 between the U.S. Department of Energy and Lockheed Martin Energy Research Corporation.

BACKGROUND OF THE INVENTION

1. Field of the Invention

The invention relates generally to an apparatus for adjusting a luggage handle, and more particularly to a telescoping luggage handle capable of extending to multiple positions by a single right or left hand actuation.

2. Description of Prior Art

Luggage cases and suitcase carts have been utilized to assist travelers in hand-carrying luggage during travels. Handles capable of adjusting the distance between the handle and the luggage are preferable for comfort during rapid transport. In Arias et al., U.S. Pat. No. 4,261,447, the device is a suitcase cart having tubular frame members and a U-shaped handle which telescopes relative to the legs of the tubular frame members. In Burtley, U.S. Pat. No. 4,036,336, the device is a suitcase having wheels on the bottom, a retractable handle, and a pair of longitudinally extendable tubes connected to the sidewall of the suitcase. In Cassimally, U.S. Pat. No. 3,960,252, the device is a combined luggage case and collapsible trolley with a foldable wheel assembly that has a sleeve which is rotatable and slidable to numerous height positions. These and other prior suitcase handles have shortcomings based on the inability to adjust the handles to a multitude of handle heights, the weight and size of the telescoping mechanisms, the durability of luggage carriers when exposed to abuse during transport, or the expense of the additional suitcase carriers. Thus there exists room for improvement within the art.

SUMMARY OF THE INVENTION

It is an object of this invention to provide an apparatus for the carrying of luggage.

It is a further object of this invention to provide an apparatus of an adjustable handle attached to a suitcase.

It is an additional object of this invention to provide an apparatus of an extendable luggage handle capable of multiple height adjustments.

It is a further and more particular object of this inventions to provide an apparatus of a luggage handle and slide tube that can extend or contract to multiple positions with a simple operation.

It is yet a further and more particular object of this invention to provide an aesthetically pleasing adjustable luggage handle that is durable during use.

These and other objects of the invention are accomplished by an apparatus and a method to provide a single hand actuation mechanism for the ambidextrous handle that is easily adjustable for height extension and contraction, and allows for pushing or pulling of the extended handle which is connected to a frame supporting the luggage. The handle, once extended allows for pushing or pulling the suit case on at least two wheels, 45 and 45' or carrying the suit case by the handle.

The apparatus for carrying luggage includes an ambidextrous handle connected to two slide tubes supported by and contained within the two fixed frame tubes, which are affixed to the two wheels 45 and 45', and together support the plastic luggage shell and hold the luggage's weight. The controls for adjustment of the slide tube are contained within the ambidextrous handle.

Thus, the objects of the invention are accomplished by the apparatus for an ambidextrous handle and extendable slide tubes attached to fixed frame tubes supporting a luggage shell as described herein.

BRIEF DESCRIPTION OF THE DRAWINGS

The invention's features and advantage will become apparent from a reading of the following detailed description, given with reference to the various figure of drawing, in which:

FIG. 8 is a bottom cross-sectional view of the rocker arm in an engaged position of the extension slide tube apparatus for mobile traveler suit case.

FIG. 9 is a cross-sectional view of greater detail of the rocker arm in a disengaged position of the extension slide tube apparatus for mobile traveler suit case.

DETAILED DESCRIPTION OF THE PREFERRED EMBODIMENT

In accordance with this invention, it has been found that an adjustable handle and telescoping arm and mechanism of a mobile suitcase frame is favorable for a traveler's carrying and movement of luggage placed on the mobile suitcase frame. In accordance with FIGS. 1–9, the preferred embodiment of the apparatus comprises an extendable, height adjustable handle 1 that is in communication with a mobile traveler luggage carrier 2. The ambidextrous adjustable handle 1, can be wrapped in leather or other synthetic material, and the handle 1 has a button 3 in a first end 4, and in a second end 4', of the handle 1, with each button 3 formed in the shape of a thimble (see detail in FIGS. 1, 2, 3, 4A and 4B for button configuration).

Figure 3:
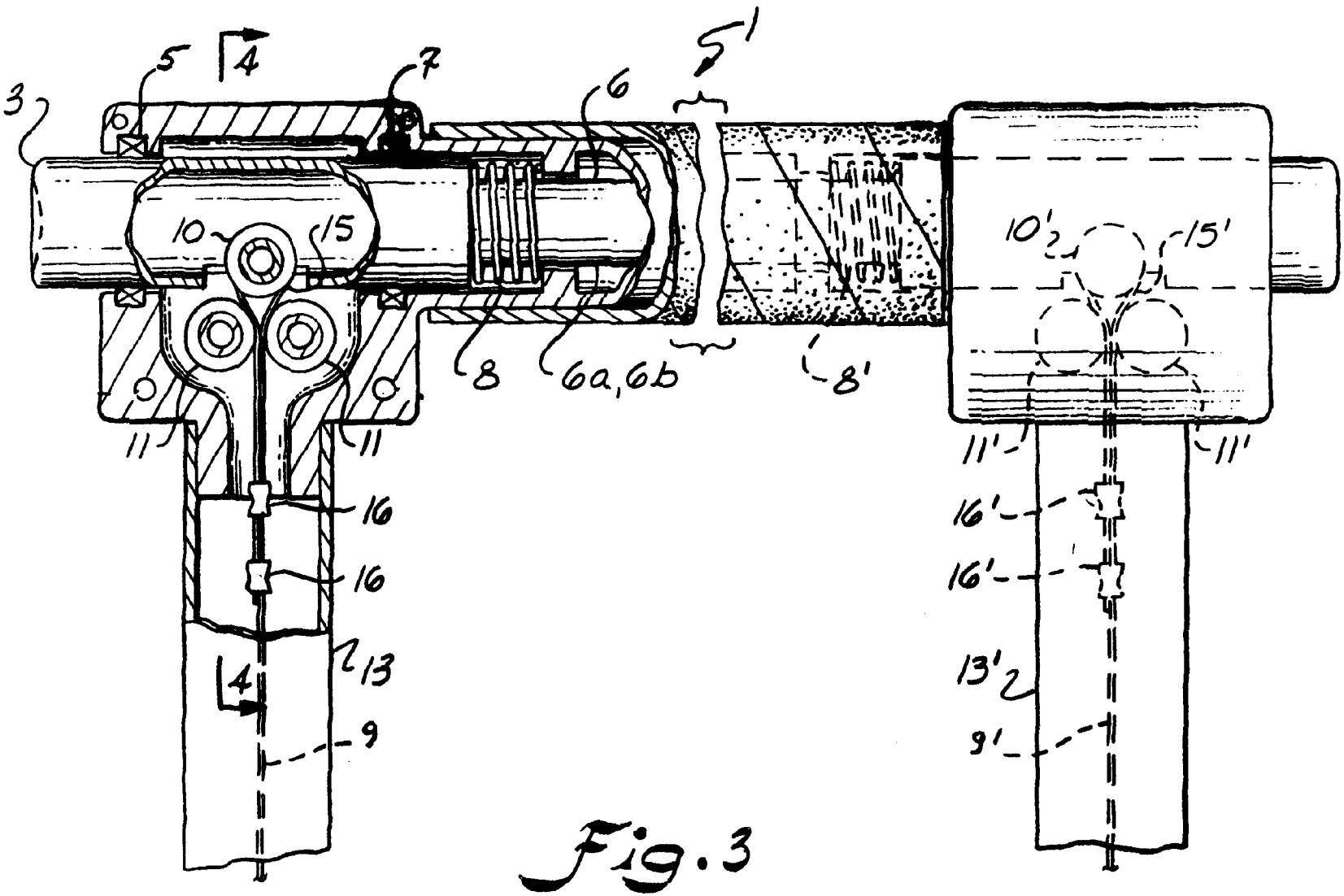
FIG. 3 is a partial cross-sectioned view expanded of the handle mechanism of the extension slide tube apparatus for mobile traveler suit case.
Figure 4A:
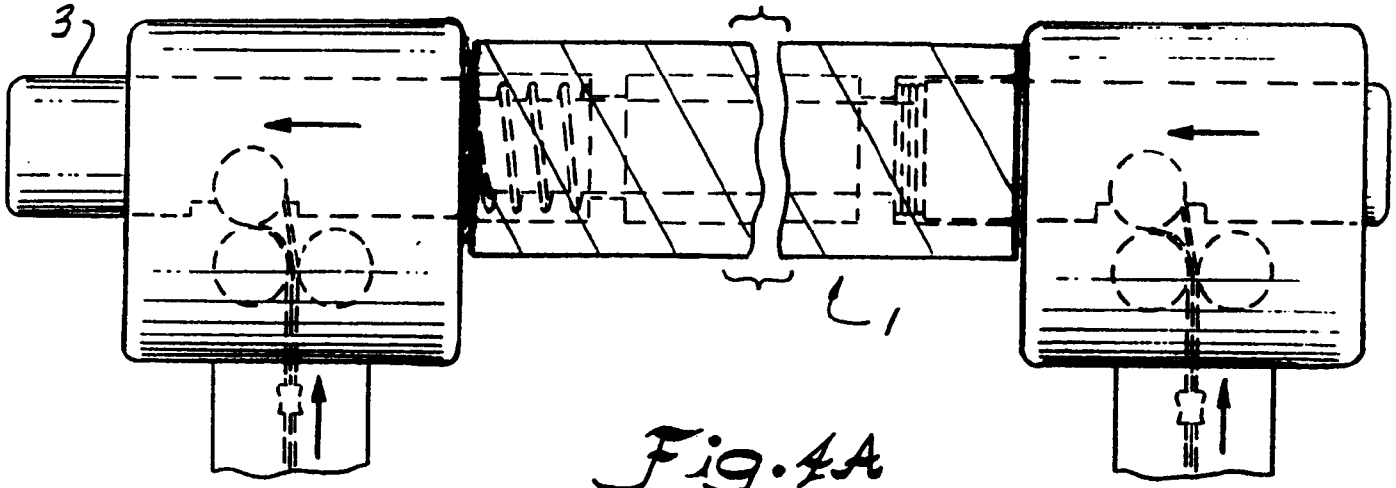
FIG. 4A and 4B are a detailed views of details in phantom detail of the handle sliding mechanism of the extension slide tube apparatus for mobile traveler suit case.
Figure 4B:
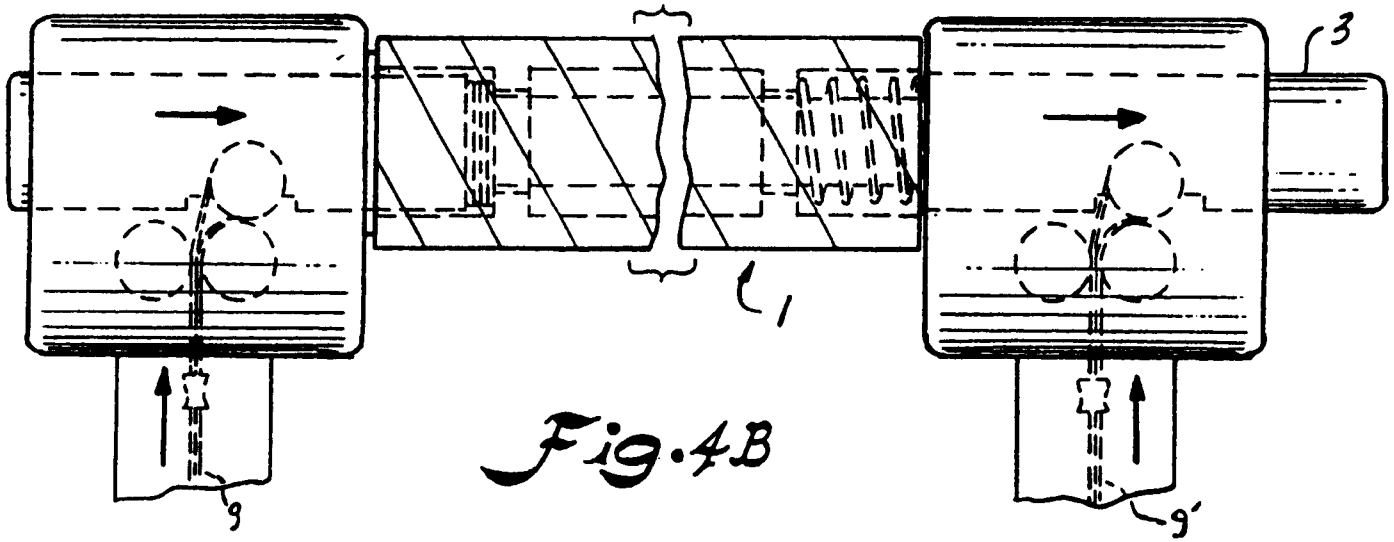

The handle 1 is manufactured out of high strength plastic in two pieces, 1*a* and 1*b* that are split along the center plane defined by the rectangular aluminum slide tubes 13 and 13'. The single hand ambidextrous actuation is accomplished by the mechanism inside handle 1. A slider cylinder 6 is manufactured out of high strength plastic in two pieces, 6*a* and 6*b* that are split along the same center plane defined by the slide tubes 13 and 13' (FIG. 3). Once assembled, handle 1 is attached to both aluminum slide tubes 13 and 13' by a pair of pins 12 and 12' (FIG. 3) to make the adjustment arm assembly.

A button 3 is seated into the handle 1 with a O-ring bearing 5 made of Teflon or comparable material, which serves as a weatherproof seal between handle 1 and button 3. A second button 3' and O-ring bearing 5' are set into the second end 4' of the handle 1, providing buttons on each end of the handle 1. The first and second buttons are interconnected by a movable slider cylinder 6 within the handle 1, which allows either the first button 3, or a second button 3' to operate the adjustment of the handle 1 height by right- or left-handled travelers. The button 3 slides in one of two directions, pulling on a filament 9 that is connected around a set of handle pulleys 11 and 11'. Two filaments, 9 and 9' can be made of Kevlar #50 and have a 3 inch long loop 15 and 15' that has crimps 16 and 16' or other method to attach the loop back to the filament at the handle end of the filament. The Kevlar filament runs inside the full length of the slide tubes 13 and 13', and is connected to the nylon rocker arms 27 and 27'. The rocker arm connection to the filament 9 is made by a six inch long nylon male wire-tie ribbon 17 and 17' that is molded over the filament. Optional method of manufacturing the filament assembly would also include tieing the Kevlar #50 into a 32 inch circumferential loop that would be looped through the female connector of a standard wire-tie. The male wire-tie ribbon 17 and 17' has 24 teeth per inch for assembly and adjustment with respect to the rocker arms 27 and 27'.

Adjustment Arm Assembly

Figure 7:
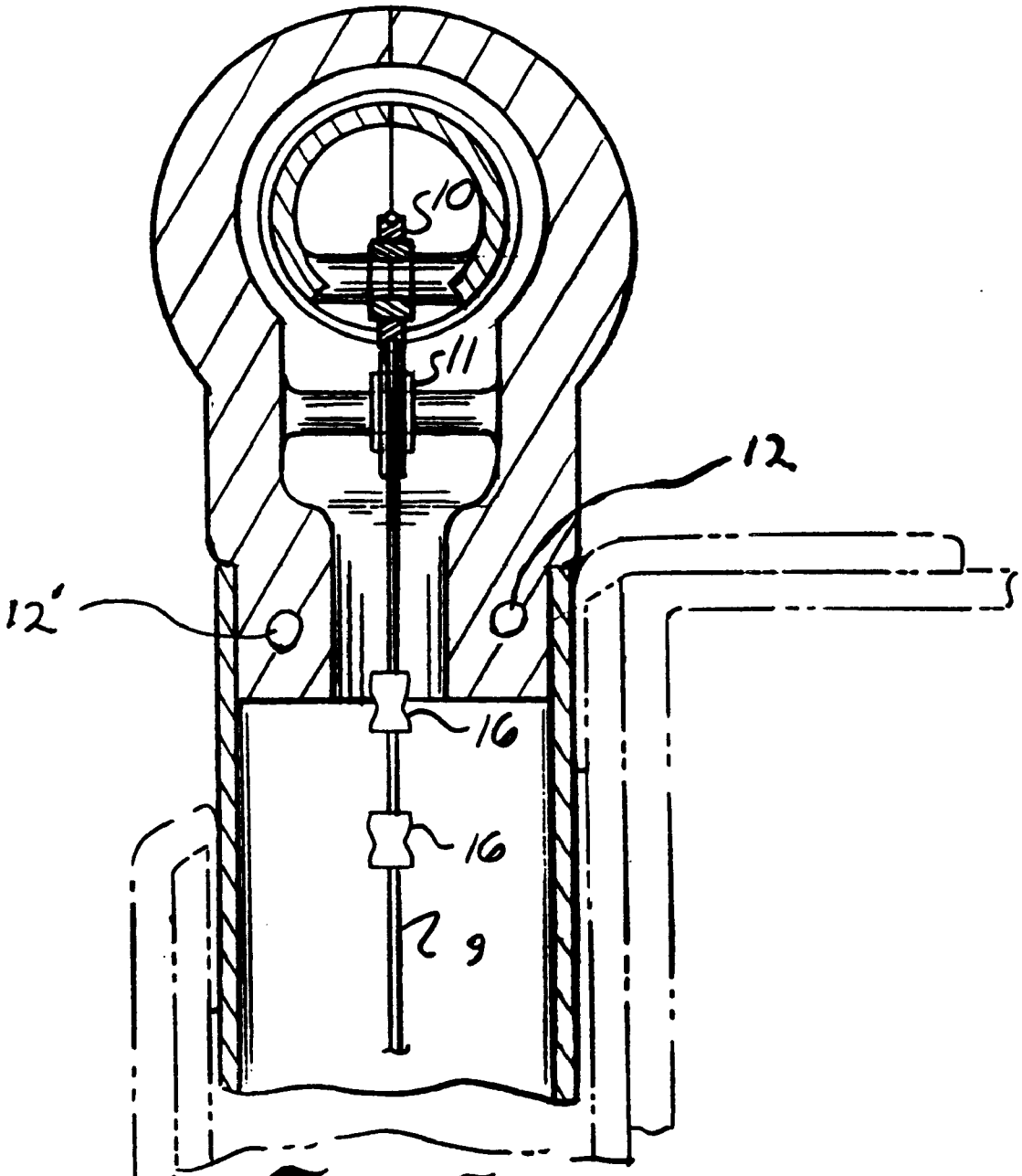
FIG. 7 is a side sectional handle functional detail of the extension slide tube apparatus for mobile traveler suit case.

The slider cylinder subassembly shown in FIG. 7 is made with slider cylinder part 6*a,* slider pulleys 10 and 10' are placed on posts molded inside of slider cylinder 6*a,* each slider pulley 10 and 10' is looped with a filament loop 15 and 15', glue can be applied to the alignment holes in slider cylinder 6*a* and then mated to slider cylinder part 6*b*. The slider return springs 8 and 8' are located around the slider cylinder 6, and are used to return the slider to the neutral position after actuation. Buttons 3 and 3' on opposing ends of the handle 4 and 4', have an external color of gold, silver, black, brown or other colors, and are glued or attached to the ends of the slider cylinder 6, Teflon or comparable plastic material O-ring's 5 and 5' are located over the buttons 3 and 3', the O-rings serve as a linear slide bearing. A split linear slide bearing 7 and 7' is placed on slider cylinder 6 on the both ends 4 and 4', of handle 1. The filament loop 15 and 15', in contact with the slider cylinder 6, completes the slider cylinder subassembly.

The handle subassembly is built placing the slider cylinder subassembly inside handle part la, taking care to place the slider cylinder return springs 8 and 8', the Teflon O-ring's 5 and 5', and the split linear slide bearing 7 and 7' in the proper groove inside handle piece 1*a*. In addition two pairs of handle pulleys 11 and 11' of the same size as the slider pulley 10 and 10', are placed on molded post inside of handle part 1*a*. Each filament loop 15 and 15' is placed between each pair of handle pulleys 11 and 11'. Glue can be applied to the alignment holes in handle part 1*a* and then mated to handle part 1*b*. The grip portion of the handle can now be wrapped with leather or some other synthetic material. The Kevlar filament 9 and 9' with the male wire-tie ribbon 17 and 17' is inserted through the inside of the slide tubes 13 and 13', and the handle 1 is inserted inside each slide tubes 13 and 13' and aligned with a pair of handle pins 12 and 12'.

The top slide arm bearings 26 and 26' are placed on the outside of slide tubes 13 and 13'. The Kevlar filament 9 and 9' with the male wire-tie ribbon 17 and 17' is partly inserted into the rocker arm adjustable/releasable wire-tie female connector 34 and 34' on the back of the rocker arms 27 and 27'. Shown in FIGS. 8 and 9, the nylon rocker arms 27 and 27' are held inside the slide tubes 13 and 13' by deforming the spring tail end 33 and 33' while inserting the rotation pin 31 and 31' into slots 28 and 28' and attaching the nylon sliding tube bottom bearings 29 and 29'. The final filament length adjustment is now made using the adjustable/releasable wire-tie female connector 34 and 34' attached to a tab 30 on the back of the rocker arm, and any extra wire-tie material is cut off. The adjustment arm assembly is installed into the fixed frame assembly.

Fixed Frame Assembly Description

Figure 1:
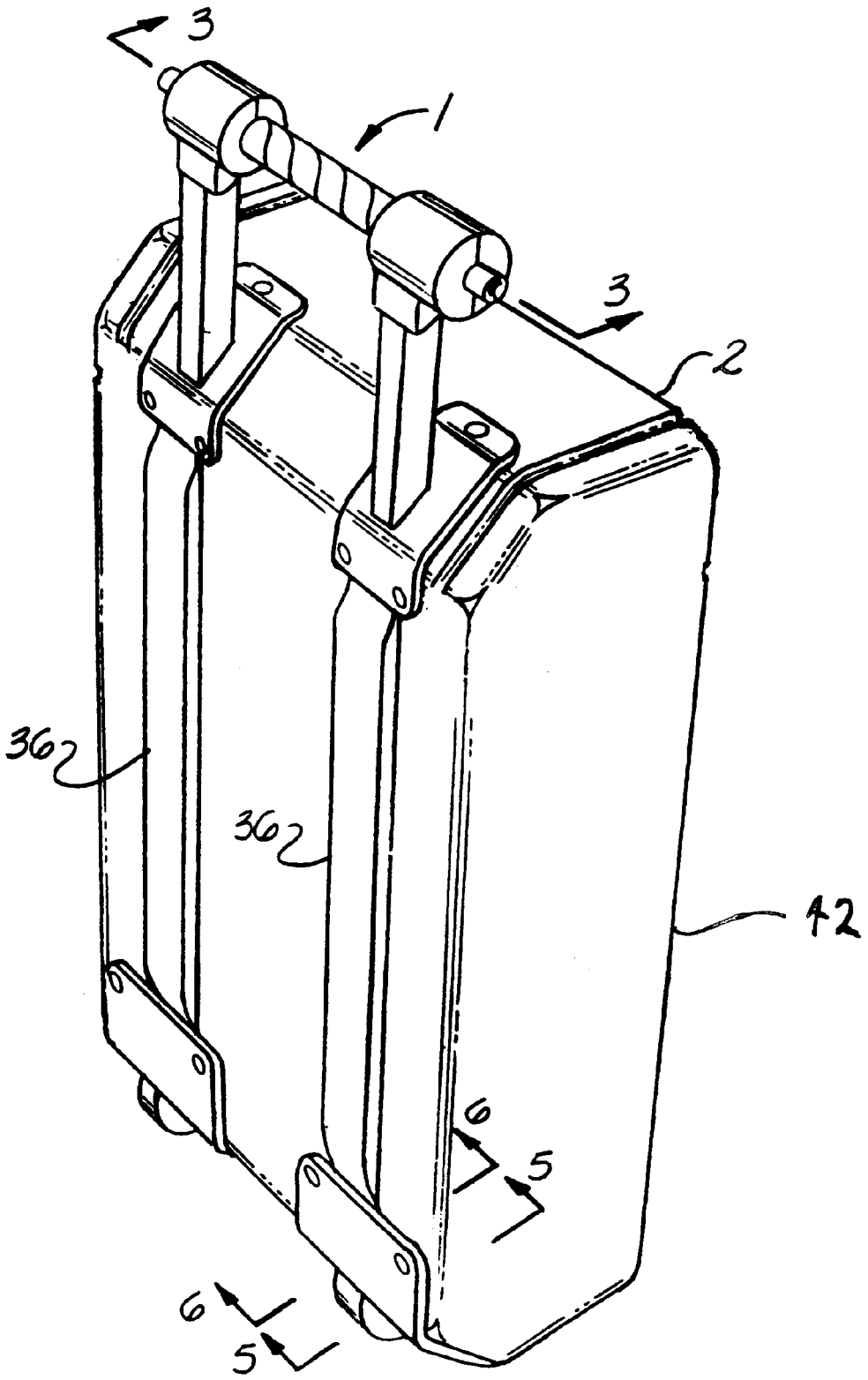
FIG. 1 is a perspective view of the extension slide tube apparatus for mobile traveler suit case.
Figure 2:
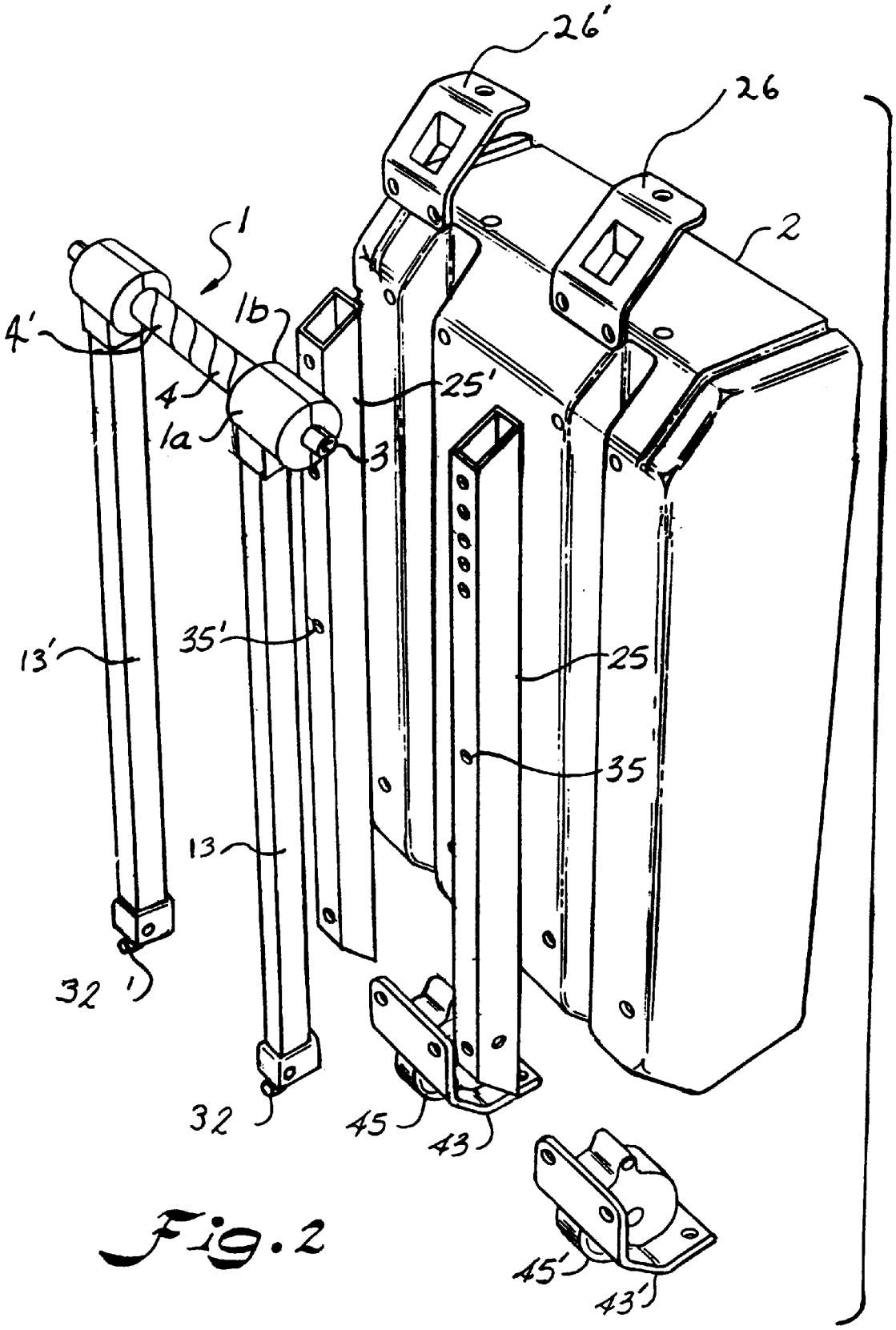
FIG. 2 is an exploded view of the extension slide tube apparatus for mobile traveler suit case.
Figure 5:
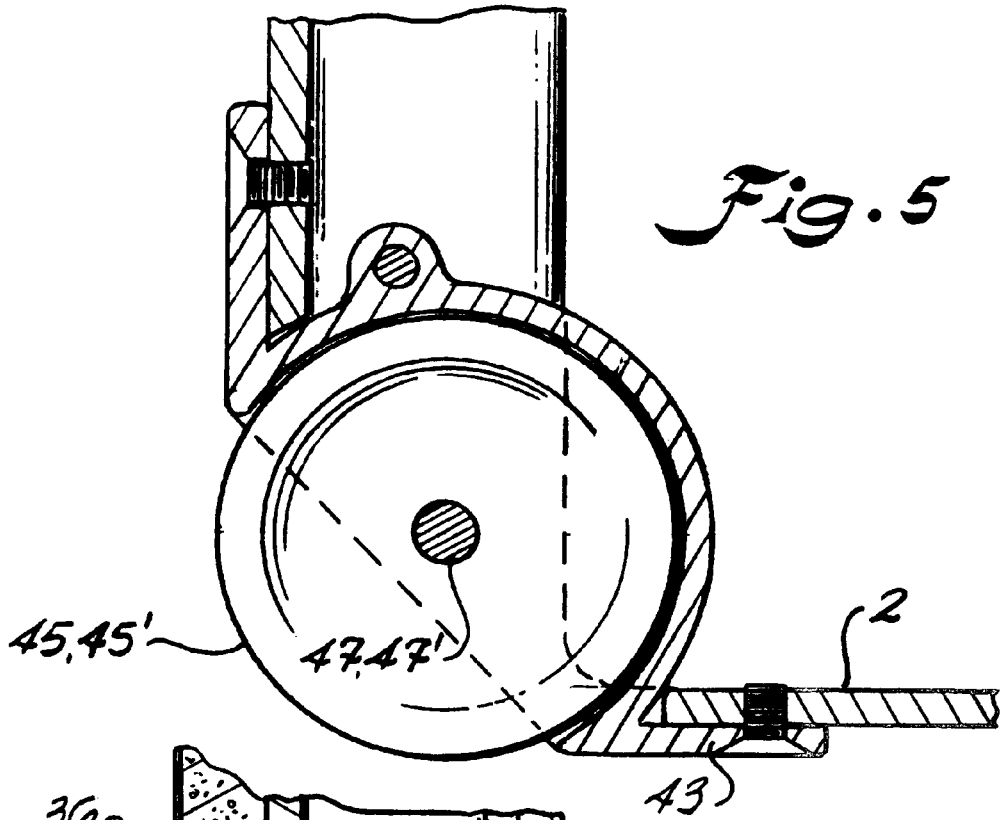
FIG. 5 is a cross-sectional of the lower portion of the wheel housing of the extension slide tube apparatus for mobile traveler suit case.
Figure 6:
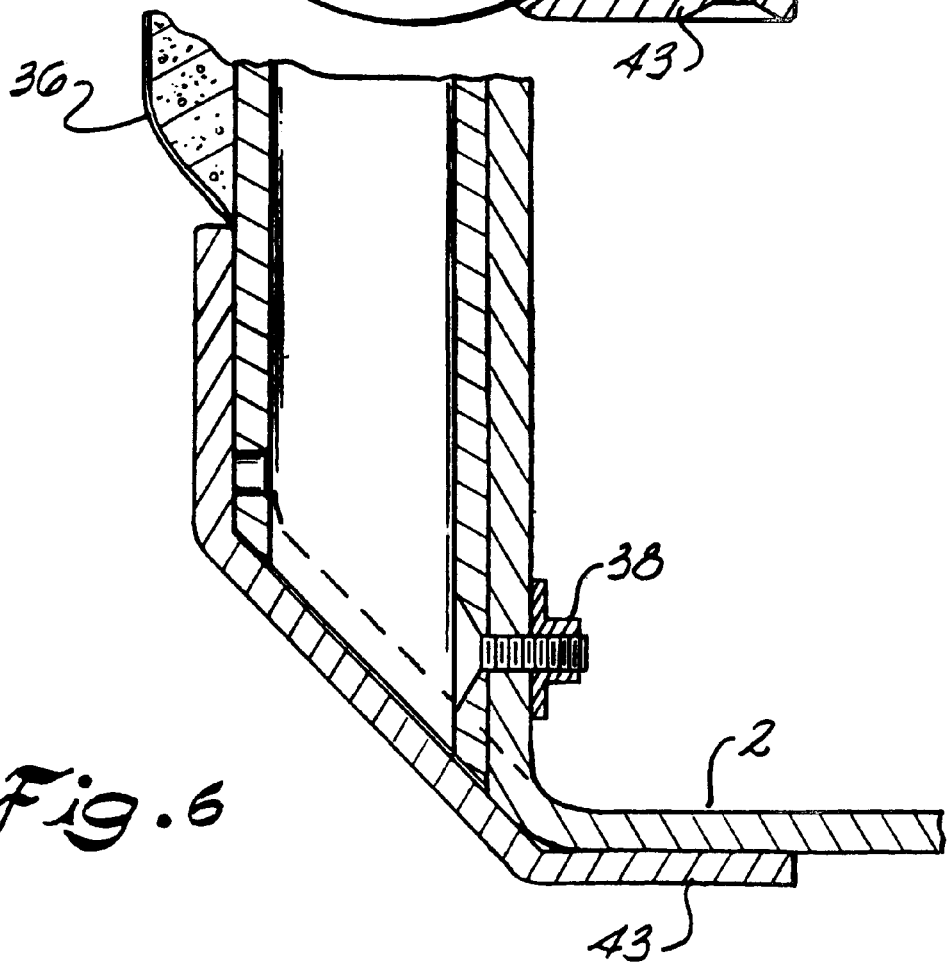
FIG. 6 is a cross-sectional exterior of the lower portion and fastener of the extension slide tube apparatus for mobile traveler suit case.

The fixed frame tubes 25 and 25' are made of rectangular aluminum tubing and are attached to the luggage shell 2, by a plurality of fasteners 38 and 38' (FIGS. 6 and 8). Each fixed frame tube 25 and 25' has a series of holes 35 and 35' for the rocker arm insertion end 32 and 32' to engage (FIGS. 2, 8, and 9). A strip of foam 36 and 36' is affixed over the holes to protect the suit case cloth covering 42 by absorbing impacts (FIGS. 1, 6, and 8). Over the foam 36 and 36' a special skid guard is stitched onto the suit case cloth covering 42 (FIGS. 1 and 6). After the suit case cloth covering 42 is applied, the wheel housings 45 and 45' are fastened to the luggage shell 2 over the suit case cloth covering 42 by a plurality of fasteners 38 and 38'. Each fixed frame tube 25 and 25' is fastened through a luggage shell wheel hole 47 and 47' and fixed frame wheel hole 48 and 48' to the wheel housing side support 43 and 43' and the fixed frame tube 25 and 25' to provide side support and load distribution for the wheel housings 45 and 45' to the fixed frame tubes 25 and 25' (FIGS. 2, 5, and 6). The luggage shell 2 is a generally rectangular plastic shell which encloses a traveler's luggage (see FIGS. 1, 2, 5, and 6).

Mobile Traveler Suit Case Assembly and Description

The mobile traveler suit case assembly is made by inserting the adjustment arm assembly into the fixed frame tubes 25 and 25'. Before the insertion is made, button 3 or 3' must be pressed to rotate the rocker arm insertion end 32 and 32' below the bottom slide tube bearing 29 and 29'. Once the adjustment arm assembly is inserted into the fixed frame tubes 25 and 25', the top slide tube bearings 26 and 26' would be placed over the suit case cloth covering 42 and inside the top end of the fixed frame tubes 25 and 25' and fastened by a plurality of fasteners 38 and 38' holding the adjustment arm assembly in place (FIGS. 6 and 8).

Method of Adjusting Extension Arm

The method of adjusting the height of the ambidextrous handle 1 in relation to the fixed frame tubes includes:

(a) compression of one of the buttons 3 and 3';

(b) forces sliding of the slider cylinder 6;

(c) the top part of each filament 9 and 9' is impacted;

(d) the filaments 9 and 9' are moved laterally with the slider pulleys 10 and 10';

(e) tension is created in each of the filament loops 15 and 15';

(f) the filament loops 15 and 15' pass over each set of pulley pairs 11 and 11';

(g) the filaments 9 and 9' extending down the length of the slide tubes 13 and 13', force tension on the distal end 23 and 23' of each filament;

(h) the distal ends 23 and 23' of each filament 9 and 9', create a pulling on the rocker arms 27 and 27' by the male wire-tie ribbons 17 and 17';

(i) the rocker arms 27 and 27' pivot and move the rocker arm insertion ends 32 and 32' out of a hole in the series of holes 35 and 35' in each fixed frame tube 25 and 25';

(j) the slide tube 13 and 13' and handle 1 are moved to another position; and (k) the rocker arm insertion ends 32 and 32' are forced into a respective second hole in the series of holes 35 and 35'.

The above sequence of motions can be repeated by the traveler until the handle 1 and the slide tubes 13 and 13' are placed in a convenient position in relation to the fixed frame tubes 25 and 25' and the luggage shell 2, for the traveler's use.

Although the present invention has been described in considerable detail with reference to a preferred version thereof, other versions are possible. For example, the materials of the apparatus may be a metal other than aluminum, or high strength graphite composite fiberglass or other materials. Also, as a modification for the female connector 34, a female end of a bolt may be utilized for attaching the wire-tie ribbon 17, with the bolt attaching through a junction on the bottom of the rocker arm 27.

Many variations will undoubtedly become apparent to one skilled in the art upon a reading of the above specification with reference to the drawings. Therefore, the spirit and scope of the appended claims should not be limited to the description of the preferred versions contained herein.

What is claimed is:

1. An apparatus for supporting luggage comprising:

a handle connected to a first and a second slide tube;

said handle having a first and second end;

a first button in said first end of said handle;

a second button in said second end of said handle;

a first filament connected to said first button of said handle, said first filament extending inside said first slide tube;

a second filament connected to said second button of said handle, said second filament extending inside said second slide tube;

a first rocker arm pivotably connected at a distal end of said first slide tube;

said first filament, first slide tube, and first rocker arm, form a first slide tube assembly placed inside a first frame tube;

said first slide tube assembly is connected to a shell;

said second filament, second slide tube, and second rocker arm, form a second slide tube assembly placed inside a second frame tube; and said second slide tube assembly is connected to a shell;

wherein said first and second slide tube assemblies are movable to a plurality of positions in reference to each respective said frame tube.

2. The apparatus according to claim 1, wherein said first and second slide tube assemblies placed inside respectively said first and second frame tubes, are connected to a plurality of wheels, said frame tubes and said wheels supporting said luggage.

3. The apparatus according to claim 1, wherein said first and second slide tube assemblies are positioned into a plurality of positions within said first and second frame tubes.

4. The apparatus according to claim 1, wherein said first and second filaments are separately in contact with a plurality of pulleys located within each of said first and second slide tubes.

5. The apparatus according to claim 4, wherein said pulleys are located inside each of said first and second slide tubes, further comprising said filaments extending across said pulleys and to the distal end of each said slide tube.

6. The apparatus according to claim 1, wherein said first and second filaments are separately connected to a first end of each said first and said second rocker arm, further comprising a pivoting movement of said first and said second rocker arms when said first and second filaments are moved.

7. The apparatus according to claim 6, wherein said first and second rocker arms each have second ends which are separately in contact with one of a plurality of holes within said first and second frame tube.

8. The apparatus according to claim 7, wherein said first and second rocker arms are connected to separate rocker arm springs.

9. The apparatus according to claim 8, wherein said rocker arm springs force each said first and second rocker arms to insert said second end of each said rocker arm into one hole of said plurality of holes within said respective frame tubes.

10. The apparatus according to claim 1, wherein said first and second frame tubes are connected to said shell, further comprising said frame tubes being connected to a plurality of wheels, said wheels attached to a lower end of each of said frame tube.

11. The apparatus according to claim 1, wherein said apparatus is in combination with an article of luggage.

* * * * *